US005086703A

United States Patent [19]

Klein

[11] Patent Number: 5,086,703

[45] Date of Patent: Feb. 11, 1992

[54] UNIVERSAL PROJECTILE AMMUNITION

[76] Inventor: John M. Klein, 5100 Wah-Ta-Wah, Clarkston, Mich. 48016

[21] Appl. No.: 651,290

[22] Filed: Feb. 5, 1991

[51] Int. Cl.[5] ..... F42B 8/02

[52] U.S. Cl. ..... 102/439; 102/444; 102/502; 102/529

[58] Field of Search ..... 102/439, 444, 447, 502, 102/514, 516, 529

[56] References Cited

U.S. PATENT DOCUMENTS

| | | | |
|---|---|---|---|
| 3,911,824 | 10/1975 | Barr et al. | 102/502 |
| 4,164,903 | 8/1979 | Bouza | 102/529 |
| 4,656,946 | 4/1987 | Gordon et al. | 102/502 |
| 4,656,947 | 4/1987 | Gordon et al. | 102/502 |
| 4,895,076 | 1/1990 | Looger et al. | 102/439 |
| 5,016,536 | 5/1991 | Brighton | 102/444 |

*Primary Examiner*—Deborah L. Kyle
*Assistant Examiner*—Richard W. Wendtland
*Attorney, Agent, or Firm*—Weintraub, DuRoss & Brady

[57] ABSTRACT

Ammunition for a riot gun with a projectile of universal application. The projectile has a fluted end, with an internal cavity, which permits varied sleeves with a fluted throughbore to be used with varied nose inserts to define the type of ammunition desired, for example, a non-shattering flat nose shatterable ceramic cover tear gas nose, or the like. The projectile, sleeve and nose are insertable into a shell casing with a projectile propellant.

16 Claims, 3 Drawing Sheets

UNIVERSAL PROJECTILE AMMUNITION

BACKGROUND OF THE INVENTION

1. Field of the Invention

This invention relates to the field of ammunition. More specifically, it relates to ammunition projectiles for use in hand held weapons such as riot guns.

2. Description of the Prior Art

As is known to those skilled in the art to which the present invention pertains, originally riot gun ammunition, typically involved a time consuming and expensive procedure not only for developing, manufacturing and inventorying, but for loading and unloading a firearm because of the specific uses of the ammunition. To alleviate this problem ammunition has been developed for such riot guns and riot control. Most commonly, this ammunition has been in the well-recognized form of "baton-type" shells which usually contain certain types of scatterable material from wood to plastic. However, accuracy has suffered with the use of scatterable ammunition and large numbers of people have been injured when this was not necessary.

The improvement of riot guns to provide for accuracy, ease of loading and automatic ejection of the spent shells, has lessened the need to use only "scatter gun" ammunition. Thus, more accurate riot gun ammunition has been developed.

However, such ammunition is traditionally designed for a single use, i.e., barricade penetration, tear gas dispersion or utilization of the projectiles against specific targets. However, no one common projectile body is useful for such uses. For example, The Royal Ordinance PLC of England has developed a riot gun cartridge or ammunition which is more accurate than the scatterable shells. While this cartridge provides additional accuracy, each specific type or nature is a single type of application or use requires specific.

Thus, it would be desirable to provide riot gun ammunition that has the desired accuracy and which employs a projectile which is usable for different types of applications, i.e. barricade penetrator, a tear gas head, solid head, etc. thus, improving upon manufacturing techniques and reducing costs. As subsequently detailed it is to this to which the present invention is directed.

SUMMARY OF THE INVENTION

The instant invention provides a universal projectile having an interchangeable close, such as a nose or head, as well as an interlocking changeable sleeve, for use in a riot control firearm. The projectile permits the ammunition to be loaded for a desired circumstance by merely choosing the correct nose configuration.

The universal projectile hereof, generally, comprises:

(a) a projectile body, answerable within a shell casing and having a central cavity formed therein;

(b) a sleeve, interlockingly mountable onto the projectile body; and (c) a closure member for sealing the central cavity.

The projectile is answerable within a shell casing.

The projectile body or baton body receives various types of sleeves and nose or head inserts. The sleeve and the nose or head insert are changeable to accommodate the type of ammunition desired.

The baton body is propelled from the shell casing by any suitable propellant or propelling charge.

The various features, advantages and other uses of the present invention will become more apparent by referring to the following description and drawing.

Throughout the following description and drawing, identical reference numbers are used to refer to the same component shown in multiple figures of the drawings.

DESCRIPTION OF THE PREFERRED EMBODIMENT

Figure 1:
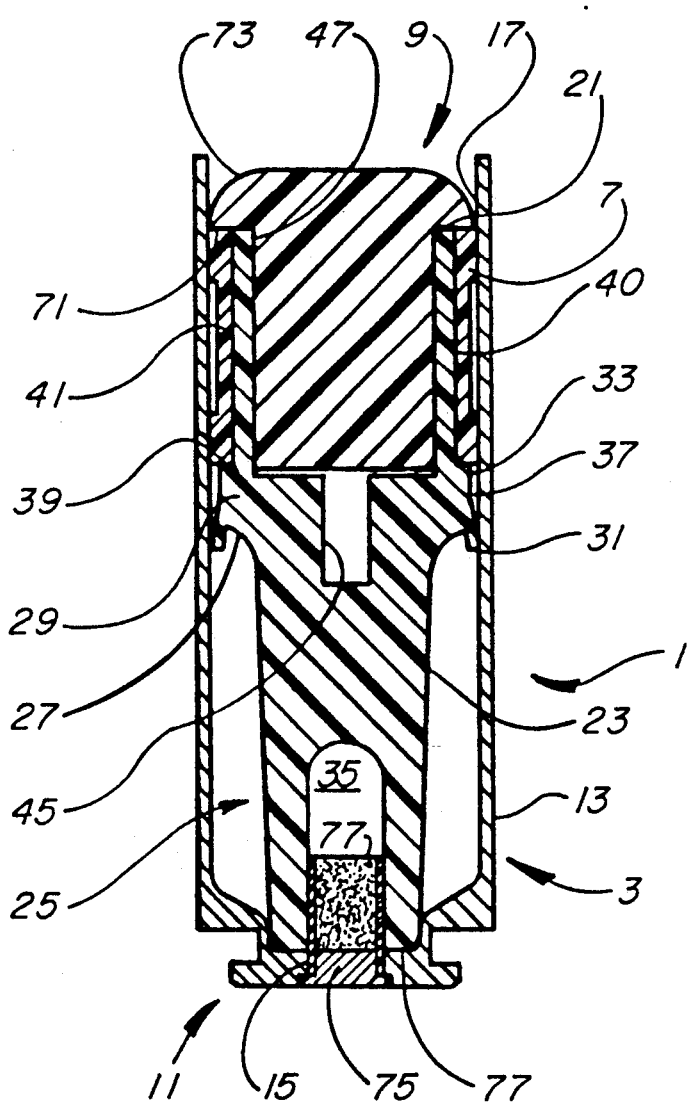
FIG. 1 is a cross-sectional view of the instant invention with a baton sleeve.
Figure 2:
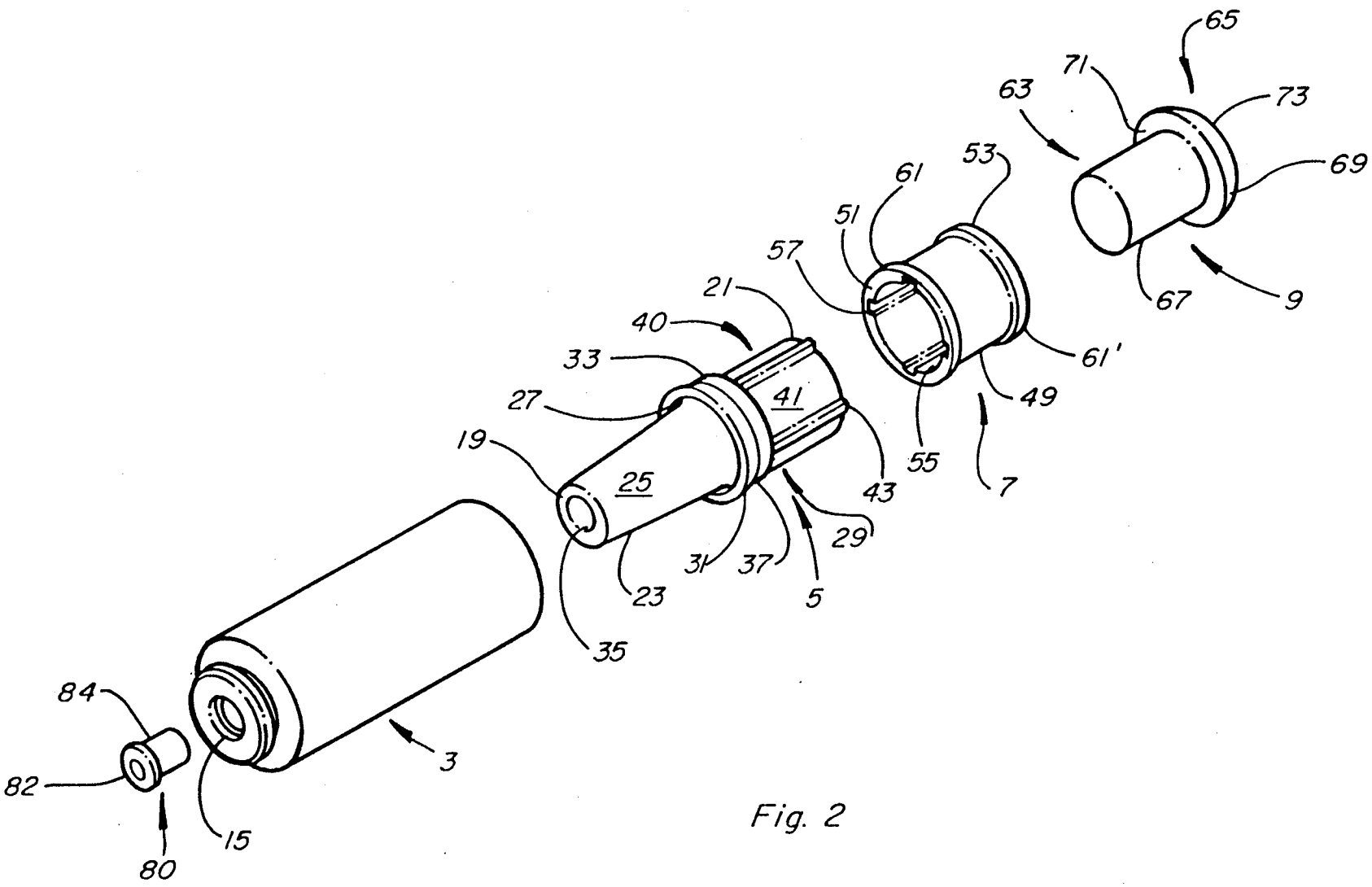
FIG. 2 is an exploded perspective view of the instant invention with a baton sleeve.

Referring now to the drawing and in particular to FIGS. 1 and 2, there is depicted a first embodiment of a universal projectile ammunition of the instant invention and, generally, denoted at 1. The universal projectile ammunition 1 hereof, generally, comprises:

(a) a projectile body or baton body 5, answerable within a shell casing 3;

(b) a baton sleeve 7, mountable on the projectile body 5; and (c) a nose or head insert or baton insert 9 answerable within the projectile 5 and sleeve 7.

The casing 3, which houses the ammunition 1, is a hollow tubular structure 13 made of metal, such as aluminum or the like. The casing 3 has a propelling charge loading orifice 15 and a payload expelling end 17. The casing 3 maintains strict compliance with the caliber or size requirement of the weapon or firearm (not shown) used to fire the ammunition 1. Also, the shell casing 3 houses both the projectile 5, which is intended to be inserted in the pay load expelling end 17, and a propellant charge 11 for the projectile proximate the orifice pocket 15.

The projectile or baton body 5 is, preferably, made from a nonmetallic material, such as a polyurethane elastomer or the like. As noted the baton body 5 is answerable within the shell casing 3.

The baton body 5, which projects into the shell casing 3, is a cylindrical member having an inserting end 19 and an issuing end 21, which, is, preferably, a fluted end. As shown, the baton body 5 has a reduced diameter, cylindrical insert member 23 extending from the and integral with the inserting end 19. The insert member 23 and the inserting end 19 cooperate to define a first leg of the body 5.

The insert member 23 has a tapered outside surface 25 to aid in the balance of the projectile and to prevent tumbling of the projectile in flight. The outside surface 25 begins at the inserting end 19 of the baton body 5 and extends outwardly to a cavity 27, provided substantially medially of the projectile 5. The cavity 27 extends within a collar 29 and merges therewith. The cavity 27 and the collar 29 acts as an obturating surface and inflates outward, upon firing, against the shell casing 3 and prevents propelling gasses from leaking therepast and, thus, forms a seal.

The collar 29 of the baton body 5 is located medially of the projectile and is integrally formed with a second leg 40 and the first leg of the baton body 5, as shown.

The collar 29 has a tapered surface 31 and a substantially circular surface 33 which defines a shoulder. A junction 37 is formed between the surfaces 31 and 33. The tapered surface 31 of the collar 29 extends outwardly from the junction 37 toward the inserting end 19 to overlay the cavity 27 to define a skirt for the cavity 27. The surface or shoulder 33 extends from the junction 37 to a sleeve mating face or ridge 39. The ridge 39 is normal to and merges with a second leg 40 or member. The leg 40, preferably, has a fluted surface 41 which extends from the shoulder 33 to the fluted end 21.

As subsequently detailed the mating face or ridge 39 cooperates with the shoulder 33 to define a stop for the sleeve 7.

The leg 40 which is a hollow, cylindrical member has a central cavity 47 formed therein. The leg 40 is parallel to the center line of the baton body 5 and has at least one fluted ridge 43 disposed on the surface 41 thereof. The ridge 43 extends along the entire surface 41 from the collar 29 to the fluted end 21.

The ridge 43 cooperates with the sleeve 7, to interlock the sleeve to the body as detailed below.

As shown in the drawing, the baton body 5 has an impact cavity 45 extending partially axially from the cavity 47.

A propelling charge cavity 35 is formed from the inserting end 19 and into the member 23. The cavity 35 encloses the propelling charge 11.

The propelling charge 11 comprises a cartridge 80 or the like which is insertable into and seals the orifice 15. The cartridge has a sealing head 82 which includes a primer pocket 83. The head 82 seats against the bottom of the casing 3. The cartridge 80, also, includes a cylindrical hollow body 84 integrally formed with and extending from the head 82. The body 84 projects into the casing 3.

The body 82 is filled with the propellant which, generally, comprises and an explosive, such as gunpowder 77 or the like. A disc or the like (not shown) seats atop the propellant and closes off the interior of the body 84.

In use, the insert end 19 of the body 5 is mounted onto the body 84 and which is, thus, at least partially inserted into the cavity 35, as shown.

The baton sleeve 7 which slidably fits onto the leg 40 is, preferably, made from a nonmetallic material, such as nylon, polyurethane elastomer or a combination of both. The sleeve 7 is a hollow, cylindrical member 49 with the first end 51 and a second end 53. The sleeve 7 has a fluted internal throughbore 55 extending from the first end 53. The fluted throughbore 55 has at least one fluted cavity 57 corresponding to the fluted ridge 43 on the baton body 5. In use, the sleeve 7 is slidably mounted onto the fluted surface 41 of the baton body. In mounting the sleeve onto the leg, a ridge 43 is slid into a corresponding cavity 57, to interlock the sleeve to the body 5 to prevent the sleeve from rotating independently from the body during firing.

The outside surface 59 of the sleeve 7 has a collar 61 circumferentially disposed about the first end 51 and a second collar 61' circumferentially disposed about the second end 53 of the sleeve 7. The collars 61, 61' act as a rotating bond to engage a rifled barrel. Moreover, when the sleeve is mounted on the leg 40, the collar 61 abuts the surface 39, and provides a continuous surface with the shoulder.

The closure is, preferably, a nose or baton insert 9 which seals the cavity 47 and assists in the definition of the type of ammunition defined by the body 5. The nose 9 is preferably made from a nonmetallic material, such as a polyurethane elastomer.

As shown the baton insert 9 projects into the cavity 47. The baton insert 9 has a stem end 63 and a cap end 65. The cap end 65 includes a cap 69 with a flat side 71 and a beveled or arcuate side 73. The stem end 63 is a cylindrical stem 67 extending to the cap 69. When the stem 67 of the nose insert 9 is emplaced within the cavity 47 of the baton body 5, the flat side 71 of the cap end 65 urges against or is in proximity to the collar 61' of second end 53 of the sleeve 7, to enclose the cavity 47. According to this embodiment of the present invention, the cavity 47 is devoid of scatterable substance, tear gas or other material.

In order to fire the ammunition 1 it is loaded into the casing 3, which is preloaded with the propellant or propelling charge 11, and which seals the bottom of the casing, as hereinabove noted. Upon firing, the projectile is issued from the casing 3 in the well-known manner.

Figure 3:
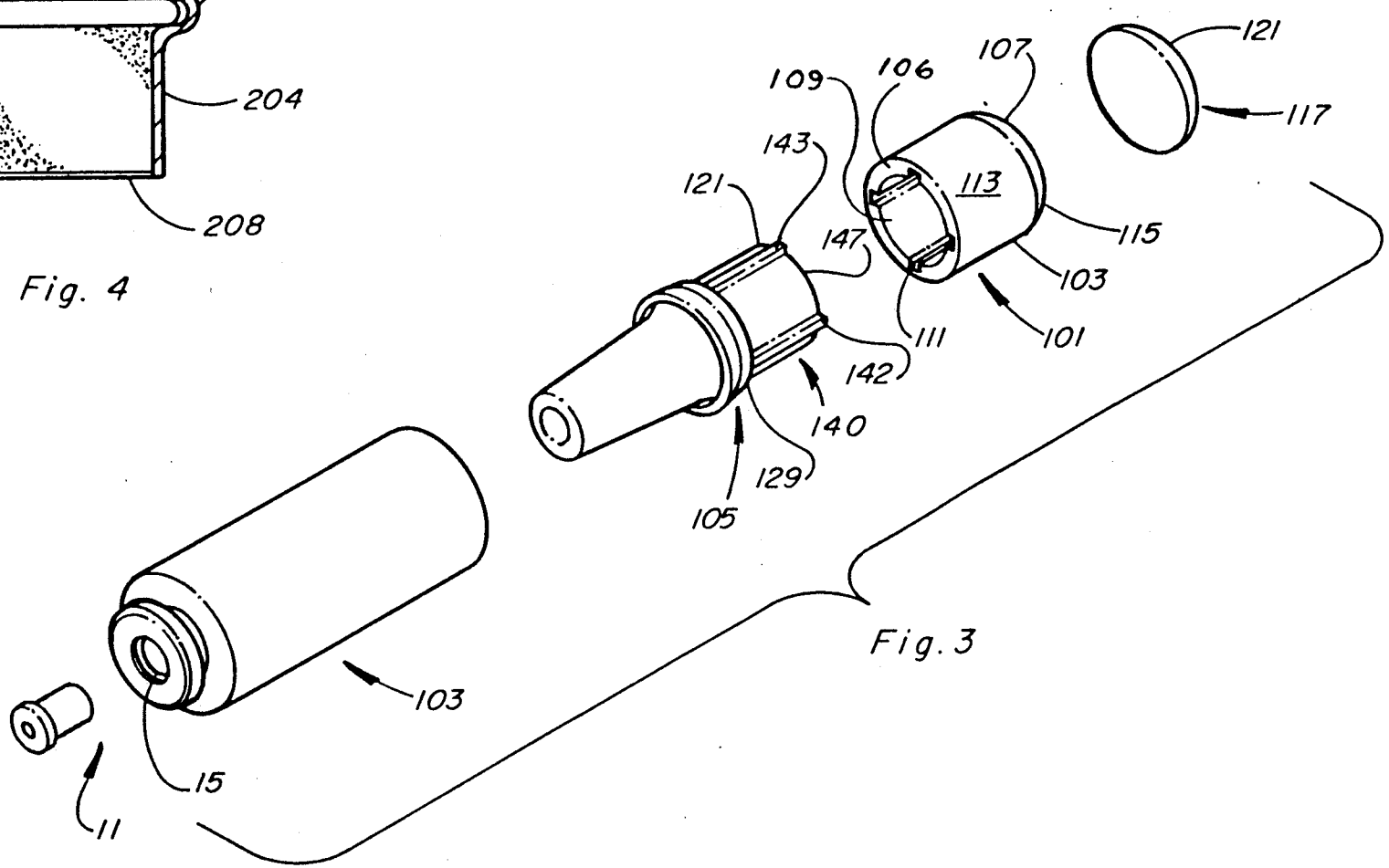
FIG. 3 is an exploded perspective view of an alternate embodiment of the instant invention with the barricade penetrator sleeve.

In another embodiment of the instant invention and as depicted in FIG. 3, the universal projectile ammunition 100, uses a similar shell casing 103 and baton body 105 as used in the embodiment of FIGS. 1 and 2.

In accordance with this embodiment, a containing sleeve or barricade penetrating sleeve 101 is mounted onto the fluted end 121 of baton body 105 urging against the collar 129. The sleeve 101 has a length longer than of the leg 140 to create a space or cavity therearound. The sleeve 101 is preferably made from a nonmetallic material, such as nylon. The sleeve 101 is a hollow, cylindrical member 103 having a flat end 106 and a beveled end 107 and an exterior surface 113. The sleeve 101, also, has a internal throughbore 109, preferably, a fluted throughbore, extending from the flat end 106 to the beveled end 107. The fluted throughbore 109 has at least one internal fluted cavity 111 provided therein which correspons with a fluted ridge 143 provided on the exterior of the second leg of the baton body 105. The outside surface 113 of the sleeve 101 terminates at a collar 115 which is, preferably, beveled, and which is disposed on the beveled end 107.

The nose or nose insert 117 is preferably made of a nonmetallic impact shatterable material, such as a ceramic or the like. The nose insert 117 is a disc-like member having a diameter equal to or slightly larger than that of the internal diameter of the sleeve 101. The nose insert of head 117 is glued or otherwise adhered to the top of the sleeve to seal or close off the central cavity. The propellant for the baton body is the same as disclosed above except that a larger charge is ordinarily employed. Because of the shatterable nature of the nose 117 this embodiment is designated as a barricade penetrator ammunition.

In accordance herewith, the cavity 147 of the baton body 105 and the space thereabove defined by the sleeve 101 are filled with powdered tear gas or other agents and the ceramic cap 121 is pressed into place. When the ammunition 1 is fired by the riot gun, the projectile penetrates the desired target area and, the ceramic cap 121 shatters on impact, thus, releasing the tear gas into the atmosphere behind the target area. Alternatively, and although not shown, the disc-like member can be inserted into the cavity and glued therewithin atop the top edge of the second leg of the body.

In this embodiment the tear gas or other agents are stored in the central cavity.

Figure 4:
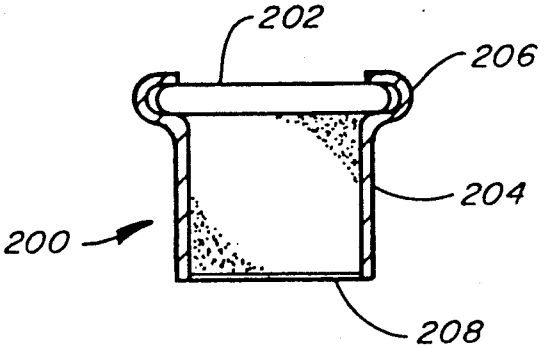
FIG. 4 is a side elevational view of an alternate embodiment of a nose insert for use herein.

In a further alternate embodiment hereof and as shown in FIG. 4, an ampule 200 is insertable into the cavity 147. The ampule has a head 202 and a hollow cylindrical, elongated body 204. A powdered tear gas or the like is emplaced within the hollow of the body 204. The head 202 is at least partially, and preferably totally, formed from a shatterable ceramic 206. The body 204 is formed from aluminum or the like. Where the head 202 is formed from ceramic, the aluminum is wrapped around the head 202, as shown. A foil seal 208 or the like seals off the bottom of the body 204. In all other respects the embodiment hereof is the same as heretofore described, i.e., includes an interlocking sleeve and a second leg etc.

It is to be, thus, appreciated by interchangeability of the requisite sleeve and nose on the body, the type of ammunition defined by the projectile can be altered. Furthermore, because the baton body is the same for either baton-type or barricade penetrating ammunition the cost of manufacture is greatly reduced.

Having, thus, described the instant invention, what is claimed is:

1. A universal projectile ammunition comprising:

(a) a projectile body, removably emplacably within a shell casing; the body having a first leg and a hollow, cylindrical second leg, the second leg having a central cavity provided therein, the second leg having at least one longitudinally extending ridge formed thereon;

(b) a sleeve mountable onto the second leg, the sleeve having at least one longitudinally extending cavity formed therein, the cavity receiving the ridge therewithin; and, (c) a closure member for sealing the central cavity.

2. The universal projectile ammunition of claim 1, wherein the sleeve is nylon.

3. The universal projectile ammunition of claim 1, wherein the closure member comprises:

a nose insert insertable within the central cavity and urging against the sleeve.

4. The ammunition of claim 2, wherein the nose insert comprises:

(a) a cap which seats against the sleeve, and (b) a stem integrally formed within the cap, the stem being insertable into the central cavity.

5. The universal projectile ammunition of claim 3, wherein the nose insert is a polyurethane elastomer insert.

6. The universal projectile ammunition of claim 3, wherein the nose insert is a ceramic insert.

7. The universal projectile ammunition of claim 6, which further comprises:

a quantity of tear gas contained within the central cavity.

8. The universal projectile ammunition of claim 1, wherein the sleeve comprises:

(a) a cylindrical member having a first end and a second end, the cylindrical member having a throughbore formed therein, the body having at least one cavity corresponding to the ridge on the projectile body formed therein;

(b) a collar disposed on the first end;

(c) a collar disposed on the second end; and (d) wherein the at least one ridge on the body is receivable in the at least one cavity to interlock the sleeve to the body.

9. The universal projectile ammunition of claim 8 which further comprises:

a quantity of tear gas contained within the central cavity.

10. The universal projectile ammunition of claim 1, wherein the sleeve comprises: a cylindrical member having a flat end and a beveled end, the cylindrical member having a throughbore with at least one cavity provided in the cavity, the cavity receiving a ridge therewithin and a beveled collar disposed at the beveled end of the sleeve.

11. The universal projectile ammunition of claim 1, wherein the closure member comprises:

(a) an ampule, disposed in the cavity, the ampule comprising:

(1) head which seals the cavity, and (2) a hollow, elongated cylindrical body formed therewith and seated in the central cavity.

12. The ammunition of claim 11 wherein the ampule further comprises:

a quantity of tear gas in the hollow body, and wherein the cap is at least partially a ceramic material.

13. A universal projectile ammunition comprising:

(a) a shell casing having a primer end and a payload expelling end;

(b) a projectile body within the casing having a first leg disposed proximate the primer end and a second leg proximate the expelling end, the second leg having at least one longitudinally extending ridge formed therealong;

(c) a sleeve mountable onto the second leg, the sleeve having at least one longitudinally extending cavity formed thereon, the cavity receiving the ridge therewithin; and, (d) closure which seals off the central cavity.

14. The universal projectile ammunition of claim 13, wherein the shell casing is aluminum.

15. The ammunition of claim 13 wherein:

the first leg of the body has an impact cavity formed therein, a propellant charge for the projectile body being insertable therewithin.

16. The universal projectile ammunition of claim 15, which further comprises:

a propellant charge disposed within the impact cavity, the propellant comprising:

(a) a primer; and (b) an explosive.

* * * * *